US010867558B2

(12) United States Patent
Kim et al.

(10) Patent No.: US 10,867,558 B2
(45) Date of Patent: Dec. 15, 2020

(54) PIXEL SENSING DEVICE AND METHOD, DATA DRIVER AND ORGANIC LIGHT-EMITTING DISPLAY DEVICE

(71) Applicant: LG Display Co., Ltd., Seoul (KR)

(72) Inventors: Junghyeon Kim, Paju-si (KR); Myunggi Lim, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 16/572,534

(22) Filed: Sep. 16, 2019

(65) Prior Publication Data

US 2020/0175923 A1 Jun. 4, 2020

(30) Foreign Application Priority Data

Nov. 29, 2018 (KR) ..... 10-2018-0150645

(51) Int. Cl.
*G09G 3/3258* (2016.01)
*G09G 3/3275* (2016.01)

(52) U.S. Cl.
CPC ..... *G09G 3/3258* (2013.01); *G09G 3/3275* (2013.01); *G09G 2310/08* (2013.01); *G09G 2320/0233* (2013.01); *G09G 2320/0295* (2013.01)

(58) Field of Classification Search
CPC ..... G06F 3/3258; G06F 3/3275
USPC ..... 345/173, 175, 213
See application file for complete search history.

(56) References Cited

U.S. PATENT DOCUMENTS 3,375,520 A * 3/1968 De Groot ..... G01S 1/245 342/389
2011/0205221 A1* 8/2011 Lin ..... G09G 3/3225 345/213
2012/0242621 A1* 9/2012 Brown ..... H01L 27/14641 345/175

(Continued)

FOREIGN PATENT DOCUMENTS

CN 107945722 A 4/2018
KR 10-2017-0023292 A 3/2017

OTHER PUBLICATIONS

The Intellectual Property Office of the United Kingdom, Combined Search and Examination Report, GB Patent Application No. 1914736.2, dated Apr. 14, 2020, seven pages.

*Primary Examiner* — Prabodh M Dharia
(74) *Attorney, Agent, or Firm* — Fenwick & West LLP

(57) ABSTRACT

A display device includes a display panel, a sensing circuit, and a compensation circuit. The sensing circuit senses a current generated by a pixel of the display panel. The sensing circuit includes an integrator circuit, a comparator, and a counter. The integrator circuit is initialized to have a first reference voltage as an output. The output of the integrator circuit changes with a rate according to the sensed current. The comparator compares the output of the integrator circuit to a second reference voltage. The counter determines a time for the output of the integrator circuit to reach the second reference voltage from the first reference voltage. The compensation circuit receives the determined time and determines a compensation amount from the received time. The compensating circuit further compensates a display voltage for the pixel by the determined compensation amount in a subsequent display frame of the display device.

17 Claims, 12 Drawing Sheets

(56) References Cited

U.S. PATENT DOCUMENTS

| | | | | |
|---|---|---|---|---|
| 2013/0082936 | A1* | 4/2013 | Islamkulov | H01L 27/14609 345/173 |
| 2015/0317028 | A1* | 11/2015 | Takahashi | G06F 3/041 345/173 |
| 2016/0093641 | A1 | 3/2016 | Takahashi | |
| 2018/0061913 | A1* | 3/2018 | Kim | G09G 3/3233 |
| 2018/0197468 | A1* | 7/2018 | Wu | G09G 3/3225 |
| 2018/0302084 | A1* | 10/2018 | Wu | H01L 29/36 |

* cited by examiner

PIXEL SENSING DEVICE AND METHOD, DATA DRIVER AND ORGANIC LIGHT-EMITTING DISPLAY DEVICE

CROSS REFERENCE TO RELATED APPLICATIONS

This application is based on and claims priority to Korea Patent Application No. 10-2018-0150645 filed on Nov. 29, 2018, which is incorporated herein by reference for all purposes as if fully set forth herein.

BACKGROUND

Field of Technology

The present disclosure relates to an organic light-emitting display device.

Background Art

An organic light-emitting display device of an active matrix type has pixels, each one including an organic light-emitting diode (hereinafter referred to as an "OLED") and a driving thin film transistor (TFT), arranged in a matrix form, and controls the brightness of an image implemented in the pixels based on the gray scale of image data. The driving TFT controls a pixel current flowing into the OLED based on a voltage applied between its gate electrode and source electrode (hereinafter referred to as a "gate-source voltage"). The amount of emission of the OLED and the brightness of a screen are determined by the pixel current.

The threshold voltage and electron mobility of the driving TFT, the operating point voltage of the OLED, etc. need to be the same in all the pixels because they determine the driving characteristics of the pixels. However, driving characteristics may be different between pixels due to various causes, such as a process characteristic and a time-varying characteristic. Such a difference in the driving characteristics causes a brightness deviation, thus limiting an implementation of a desired image. In order to compensate for a brightness deviation between pixels, there has been known an external compensation technology for sensing the driving characteristics of pixels and compensating for the data of an input image based on a result of the sensing.

SUMMARY

The external compensation technology includes a method using sensing means and an analog to digital converter (hereinafter referred to as an "ADC") in order to sense the driving characteristics of a pixel. The sensing means and the ADC are mounted on a driver integrated circuit (hereinafter referred to as an "IC").

The sensing means includes a sample and hold circuit, a scaler circuit, etc. in order to output a sensing output voltage to the ADC. The sample and hold circuit and the scaler circuit occupy a large area of a driver IC because they are connected to each sensing channel.

The ADC converts a sensing output voltage, received from the sensing means, into a digital signal. The ADC has a pre-determined sensible input voltage range, that is, a pre-determined sensing range. However, the section that may be actually sensed in the ADC is narrower than a sensing range specified in the ADC because reliability of a boundary part (the start and end parts of the range) is low even within the sensing range.

Accordingly, the present disclosure provides a pixel sensing device, an organic light-emitting display device including the pixel sensing device, and a method of sensing a pixel of the organic light-emitting display device, which can reduce the chip size of a driver IC by simplifying sensing means and also improve sensing reliability by widening an actually sensible range.

In some embodiments, a display device includes a display panel, a sensing circuit, and a compensation circuit. The sensing circuit senses a current generated by a pixel of the display panel. The sensing circuit includes an integrator circuit, a comparator, and a counter. The integrator circuit is initialized to have a first reference voltage as an output. The output of the integrator circuit changes with a rate according to the sensed current. The comparator compares the output of the integrator circuit to a second reference voltage. The counter determines a time for the output of the integrator circuit to reach the second reference voltage from the first reference voltage. The compensation circuit receives the determined time and determines a compensation amount from the received time. The compensating circuit further compensates a display voltage for the pixel by the determined compensation amount in a subsequent display frame of the display device.

In one embodiment, the integrator circuit includes an amplifier, a feedback capacitor, and a reset switch. The amplifier has a first input receiving the first reference voltage and a second input coupled to an output of the pixel. The feedback capacitor is coupled between the second input of the amplifier and an output of the amplifier. The reset switch is coupled between the second input of the amplifier and the output of the amplifier. The reset switch is in parallel with the feedback capacitor.

In one embodiment, the reset switch is closed to initialize the output of the integrator circuit to be the first reference voltage.

In one embodiment, the reset switch is opened after the output of the integrator circuit has been initialized to allow the output of the integrator circuit to change.

In one embodiment, the comparator has a first input receiving the output of the integrator circuit and a second input for receiving the second reference voltage.

In one embodiment, the display device further includes an offset removal circuit coupled to the first input and the second input of the integrator circuit. The offset removal circuit corrects an offset between the first input of the integrator circuit and the second input of the integrator circuit.

In one embodiment, the output of the comparator has a first value for enabling the counter when the output of the integrator circuit is greater than the second reference voltage. Moreover, the output of the comparator has a second value for disabling the counter when the output of the integrator circuit is lower than the second reference voltage.

In one embodiment, the counter receives a clock signal. The counter is configured to count clock pulses of the clock signal when the output of the comparator has the first value.

In one embodiment, the display device further includes a selector receiving as inputs multiple clock signals, each having a different frequency. The selector selects one of the clock signals in response to a selection signal. The selected clock signal has a first frequency responding to a first predicted time for the output of the integrator circuit to change from the first reference voltage level to the second reference voltage level. The selected clock signal has a second frequency in response to a second predicted time for the output of the integrator circuit to change from the first reference voltage level to the second reference voltage level.

In one embodiment, the sense current is generated by a diving transistor of the pixel in response to a preset data voltage.

Embodiments also includes a pixel circuit including a sensing current coupled to a display panel. The sensing circuit senses a current generated by a pixel of the display panel. The sensing circuit includes an integrator, a comparator, and a counter. The integrator is initialized to have a first reference voltage as an output. The output of the integrator changes with a rate according to a second current. The comparator compares the output of the integrator circuit to a second reference voltage. The counter determines a time for the output of the integrator circuit to reach the second reference voltage from the first reference voltage.

The comparator of the pixel sensing circuit has a first input receiving the output of the integrator circuit and a second input for receiving the second reference voltage. The output of the comparator has a first value for enabling the counter when the output of the integrator circuit is greater than the second reference voltage. The output of the comparator has a second value for disabling the counter when the output of the integrator circuit is lower than the second reference voltage.

Embodiments are also directed to a method for sensing a pixel of a display device. An output voltage of a sensing circuit is generated based on pixel current from the pixel. A time for the output voltage of the sensing circuit to change from a first reference voltage level to a second reference voltage level is determined, and a compensation amount is determined from the determined time. Finally, a display voltage for the pixel is compensated by the determined compensation amount in a subsequent display frame of the display device.

In one embodiment, the output voltage of the sensing current is generated by initializing an output of an integrator circuit to have the first reference voltage level, integrating the pixel current to generate the output of the integrator circuit having a rate according to a magnitude of the pixel current. Moreover, the time for the output voltage of the sensing circuit to change from the first reference voltage level to the second reference voltage level is determined by determining a time for the output of the integrator circuit to change from the first reference voltage to the second reference voltage level.

In one embodiment, an offset between a first input and a second input of the integrator circuit is corrected during initialization of the output of the integrator circuit.

In one embodiment, the time for the output voltage of the sensing circuit to change from the first reference voltage level to the second reference voltage level is determined by counting a number of clock pulses of a clock signal until the output of the sensing circuit reaches the second reference voltage level.

In one embodiment, the time for the output voltage of the sensing circuit to change from the first reference voltage level to the second reference voltage level is determined by enabling the counter to start counting the number of clock pulses of the clock signal, and disabling the counter to stop counting the number of clock pulses of the clock signal when the output of the sensing circuit reaches the second reference voltage level or less.

In one embodiment, the number of clock pulses of the clock signal are counted until the output of the sensing circuit reaches the second reference voltage by comparing the output of the sensing circuit to the second reference voltage level, generating a counter enable signal to have a first value when the output of the sensing circuit is larger than the second reference voltage level, and generating the counter enable signal to have a second value when the output of the sensing circuit is lower than the second reference voltage level.

In some one embodiment, the number of clock pulses of the clock signal are counted by enabling the counter when the counter enable signal has the first value.

In one embodiment, the time for the output voltage of the sensing circuit to change from the first reference voltage level to the second reference voltage level is determined by selecting the clock signal from a set of clock signals each of which has a different frequency. The selected clock signal has a first frequency responsive to a first predicted time for the output of the sensing circuit to change from the first reference voltage level to the second reference voltage level. The selected clock signal has a second frequency responsive to a second predicted time for the output of the sensing circuit to change from the first reference voltage level to the second reference voltage level.

BRIEF DESCRIPTION OF THE DRAWINGS

The accompanying drawings, which are included to provide a further understanding of the present disclosure and are incorporated in and constitute a part of this specification, exemplarily represent embodiments of the present disclosure and together with the description serve to explain the principles of the present disclosure. In the drawings.

DETAILED DESCRIPTION

Figure 1:
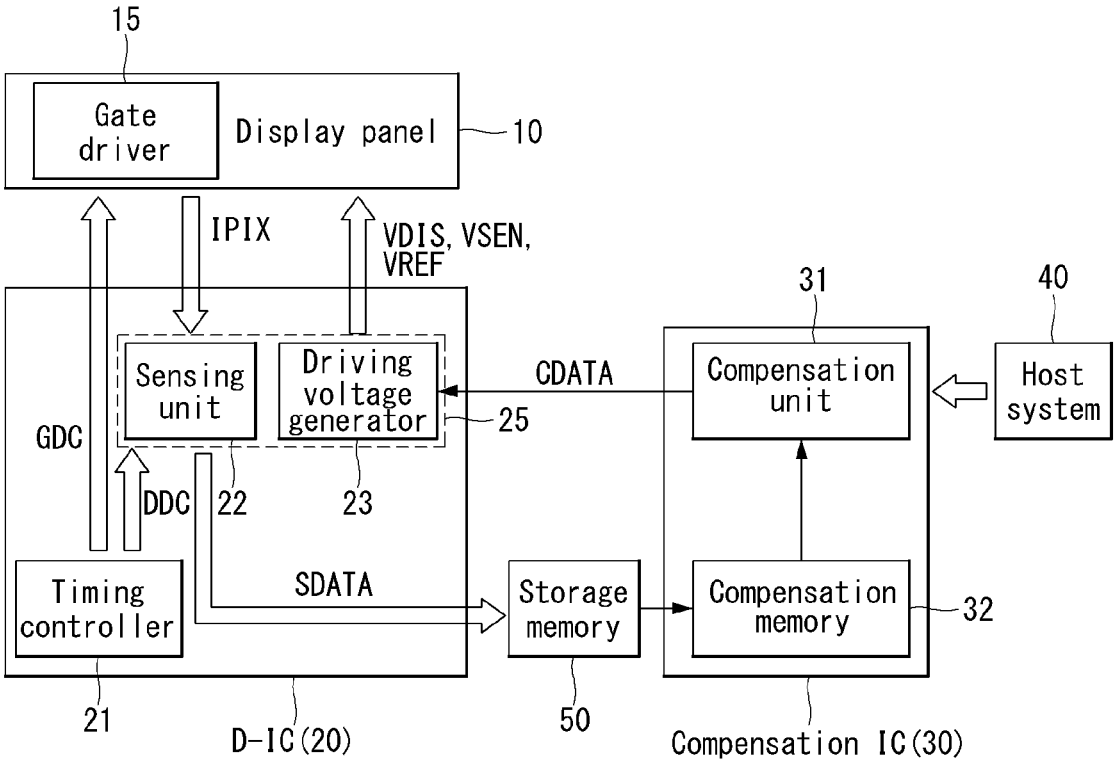
FIG. 1 is a diagram showing an organic light-emitting display device according to an embodiment of the present disclosure.

The merits and characteristics of this specification and a method for achieving the merits and characteristics will become more apparent from the embodiments described in detail in conjunction with the accompanying drawings. However, this specification is not limited to the disclosed embodiments, but may be implemented in various different ways. The embodiments are provided to only complete the explanation of this specification and to allow those skilled in the art to understand the category of this specification. The same reference numerals will be used to refer to the same or similar elements throughout the drawings.

A shape, size, ratio, angle, and number disclosed in the drawings for illustrating embodiments of this specification are illustrative, and thus this specification is not limited to contents shown in this specification. Through the specification, the same reference numeral denotes the same element. If a term, such as "include (or comprise)", "have" or "consist of (or formed of)" mentioned in this specification, is used, another part may be added unless "only" is used. If an element is expressed in the singular form, it includes a case where the element is a plural form unless specially described otherwise.

In interpreting an element, the interpretation is construed as including an error range unless explicitly described otherwise separately.

In the case of a description regarding a location relation, for example, if the location relation between two parts is described using "on", "above (or over)", "under (or below)", or "next to", for example, one or more parts may be positioned between the two parts unless a term, such as "immediately" or "directly", is used.

The first, the second, etc. may be used to describe various elements, but the elements are not restricted by the terms. The terms are used to only distinguish one element from the other element. Accordingly, a first element to be described hereunder may be a second element within the technical spirit of this specification.

In this specification, a pixel circuit formed on the substrate of a display panel may be implemented as a TFT having an n type metal oxide semiconductor field effect transistor (MOSFET) structure or may be implemented as a TFT having a p type MOSFET structure. The TFT is a 3-electrode device including a gate, a source and a drain. The source is an electrode supplying carriers to the transistor. The carrier starts to flow from the source within the TFT. The drain is an electrode from which the carrier within the TFT exits to the outside. That is, the carrier flows from the source to the drain within the MOSFET. In the case of an n type TFT (NMOS), a source voltage is lower than a drain voltage so that electrons can flow from the source to the drain because carriers are electrons. In the n type TFT, an electric current flows from the drain to the source because electrons flow from the source to the drain. In contrast, in the case of a p type TFT (PMOS), a source voltage is higher than a drain voltage so that holes can flow from the source to the drain because carriers are holes. In the p type TFT, an electric current flows from the source to the drain because holes flow from the source to the drain. It is to be noted that the source and drain of the MOSFET are not fixed. For example, the source and drain of the MOSFET may be changed depending on an applied voltage.

In this specification, the semiconductor layer of a TFT may be implemented by at least any one of an oxide element, an amorphous silicon element or a polysilicon element.

Hereinafter, embodiments of this specification are described in detail with reference to the accompanying drawings. In the following description, a detailed description of a known function or element related to this specification is omitted if it is determined that the detailed description unnecessarily makes the gist of this specification vague.

FIG. 1 is a diagram showing an organic light-emitting display device according to an embodiment of the present disclosure. Furthermore, FIG. 2 is a diagram showing an example of a pixel array included in a display panel of FIG. 1.

Figure 2:
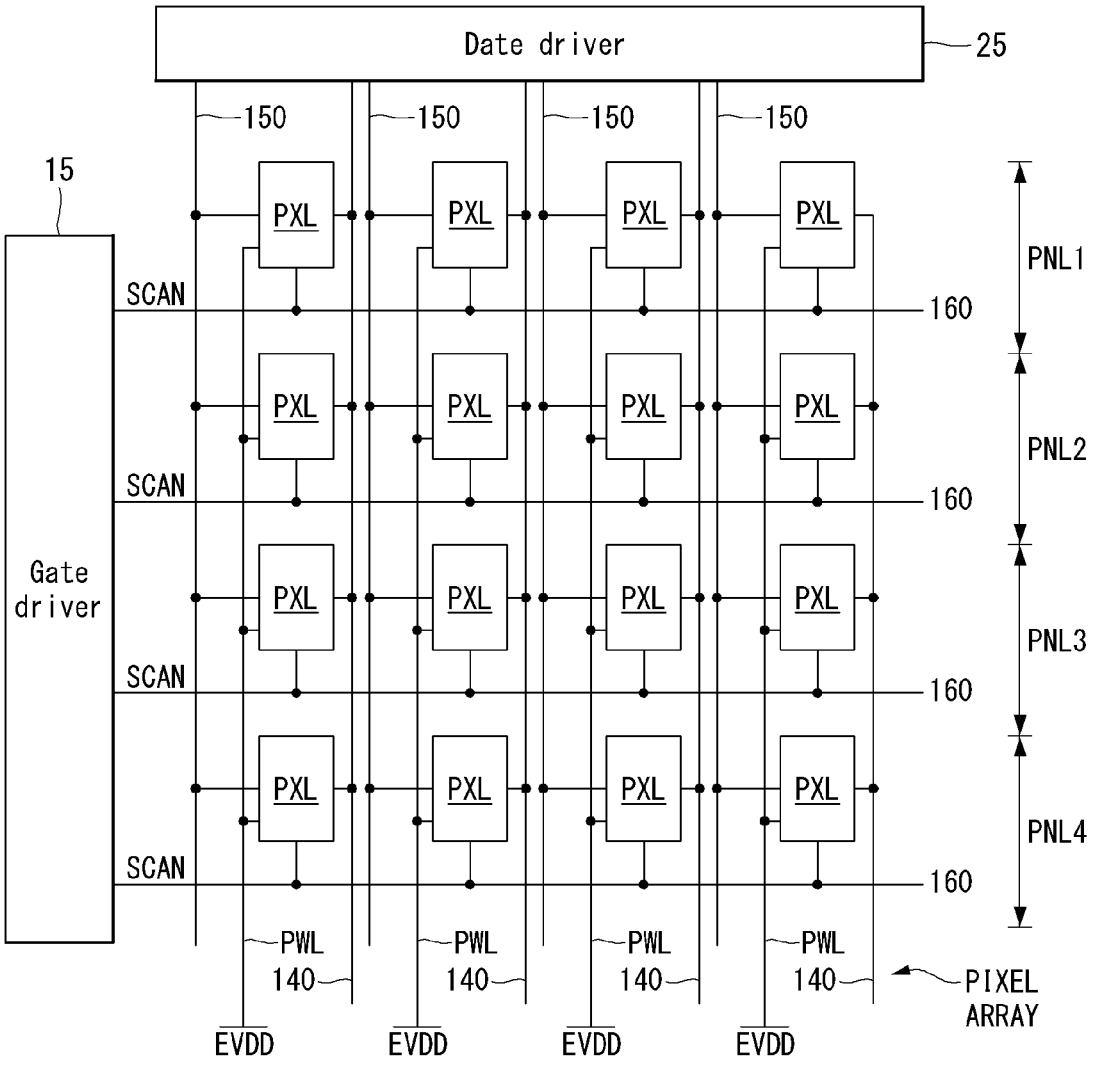
FIG. 2 is a diagram showing an example of a pixel array included in the display panel of FIG. 1.

Referring to FIGS. 1 and 2, the organic light-emitting display device according to an embodiment of the present disclosure may include a display panel 10, a driver IC (D-IC) 20, a compensation IC 30, a host system 40, and storage memory 50. A panel driving unit according to an embodiment of the present disclosure includes a gate driver 15 included in the display panel 10 and a data driver 25 embedded in the driver IC (D-IC) 20.

The display panel 10 is equipped with a plurality of pixel lines PNL1~PNL4. Each pixel line is equipped with multiple pixels PXL and a plurality of signal lines. The "pixel line" described in the present disclosure is not a physical signal line, but means an assembly of pixels PXL and signal lines adjacent to each other in the extension direction of a gate line. The signal lines may include data lines 140 for supplying the pixels PXL with a data voltage for display VDIS and a data voltage for sensing VSEN, reference voltage lines 150 for supplying a pixel reference voltage VREF to the pixels PXL, gate lines 160 for supplying a gate signal to the pixels PXL, and high potential power lines PWL for supplying high potential pixel voltages to the pixels PXL.

The pixels PXL of the display panel 10 are disposed in a matrix form to configure a pixel array. Each pixel PXL included in the pixel array of FIG. 2 may be connected to any one of the data lines 140, any one of the reference voltage lines 150, any one of the high potential power lines PWL, and any one of the gate lines 160. Each of the pixels PXL included in the pixel array of FIG. 2 may be connected to a plurality of the gate lines 160. Furthermore, each pixel PXL included in the pixel array of FIG. 2 may be further supplied with a low potential pixel voltage from a power generator. The power generator may supply the low potential pixel voltage to the pixel PXL through a low potential power line or pad unit.

The gate driver 15 may be embedded in the display panel 10.

The gate driver 15 may include a plurality of stages connected to the gate lines 160 of the pixel array of FIG. 2. The stages may generate a gate signal for controlling the switch elements of the pixels PXL and supply it to the gate lines 160.

The driver IC (D-IC) 20 includes a timing controller 21 and a data driver 25. The data driver 25 may include a sensing unit 22 and a driving voltage generator 23, but is not limited thereto.

The timing controller 21 may generate a gate timing control signal GDC for controlling the operating timing of the gate driver 15 and a data timing control signal DDC for controlling the operating timing of the data driver 25 with reference to timing signals received from the host system 40, for example, a vertical sync signal Vsync, a horizontal sync signal Hsync, a dot clock signal DCLK and a data enable signal DE.

The data timing control signal DDC may include a source start pulse, a source sampling clock, and a source output enable signal, but is not limited thereto. The source start pulse controls data sampling start timing of the driving voltage generator 23. The source sampling clock is a clock signal that controls the sampling timing of data based on a rising or falling edge. The source output enable signal controls output timing of the driving voltage generator 23.

The gate timing control signal GDC may include a gate start pulse and a gate shift clock, but is not limited thereto. The gate start pulse is applied to a stage that generates the first gate output, thereby activating the operation of the stage. The gate shift clock is input to the stages in common, and is a clock signal for shifting a gate start pulse.

The timing controller 21 may sense the driving characteristics of the pixels PXL in at least any one of a power-on period, the vertical active period of each frame, the vertical blank period of each frame, or a power-off period by controlling operating timing of the panel driving unit. In this case, the power-on period is the period until a screen is turned on after system power is applied. The power-off period is the period until system power is released after a screen is turned off. The vertical active period is the period in which image data is written in the display panel 10 for screen playback. The vertical blank period is a period, which is positioned between neighboring vertical active periods and in which the writing of image data is stopped. The driving characteristics of the pixels PXL include the threshold voltage and electron mobility of driving elements included in the pixels PXL.

The timing controller 21 may implement display driving and sensing driving by controlling sensing driving timing and display driving timing of the pixel lines PNL1~PNL4 of the display panel 10 according to a predetermined sequence.

The timing controller 21 may generate timing control signals GDC and DDC for display driving and timing control signals GDC and DDC for sensing driving. Sensing driving means that the driving characteristics of corresponding pixels PXL are sensed by writing a data voltage for sensing VSEN in pixels PXL included in a target sensing pixel line, and a compensation value for compensating for a change in the driving characteristics of the corresponding pixels PXL is updated based on sensing result data SDATA. Furthermore, display driving means that digital image data to be input to corresponding pixels PXL is corrected based on an updated compensation value, and an input image is displayed by applying a data voltage for display VDIS, corresponding to the corrected image data CDATA, to the corresponding pixels PXL.

The driving voltage generator 23 is implemented by a digital to analog converter (hereinafter referred to as a "DAC") for converting a digital signal into an analog signal. The driving voltage generator 23 generates the data voltage for sensing VSEN necessary for sensing driving and the data voltage for display VDIS necessary for display driving, and supplies the data voltages to the data lines 140. The driving voltage generator 23 generates the pixel reference voltage VREF further necessary for sensing driving and display driving, and supplies the pixel reference voltage to the reference voltage lines 150.

The data voltage for display VDIS is a result of digital to analog conversion for digital image data CDATA corrected in the compensation IC 30, and may have a different size in a pixel unit depending on a gray scale value and a compensation value. The data voltage for sensing VSEN may be differently set in an R (red), G (green), B (blue), W (white) pixel unit by taking into consideration the driving characteristics of a driving element for each color.

The sensing unit 22 may sense the driving characteristics of pixels PXL, for example, the threshold voltage and electron mobility of a driving element, the operating point voltage of a light-emitting device, etc. through sensing lines for sensing driving. The sensing lines may be implemented as the data lines 140 or may be implemented as the reference voltage lines 150. In this case, if the data lines 140 are used as the sensing lines, it is advantageous to reduce the number of pads of the driver IC (D-IC) 20 because a data output channel and a sensing channel can be united. The sensing unit 22 may be implemented in a current sensing type in which a pixel current flowing into each pixel PXL is directly sensed. The sensing unit 22 may include a current integrator, a comparator and a counter, which are described in detail with reference to FIG. 9.

The sensing unit 22 senses the time taken for a sensing output voltage to reach a specific voltage. The sensing unit 22 outputs the time taken for the sensing output voltage to reach a specific voltage as the sensing result data SDATA.

The storage memory 50 stores sensing result data SDATA, received from the sensing unit 22, upon sensing driving. The storage memory 50 may be implemented by flash memory, but is not limited thereto.

The compensation IC 30 may include a compensation unit 31 and compensation memory 32. The compensation memory 32 transmits digital sensing result data SDATA, read from the storage memory 50, to the compensation unit 31. The compensation memory 32 may be random access memory (RAM), for example, double data rate synchronous dynamic RAM (DDR SDRAM), but is not limited thereto. The compensation unit 31 computes a compensation offset and compensation gain for each pixel based on digital sensing result data SDATA received from the storage memory 50, corrects image data received from the host system 40 based on the computed compensation offset and compensation gain, and supplies corrected image data CDATA to the driver IC 20.

Figure 3:
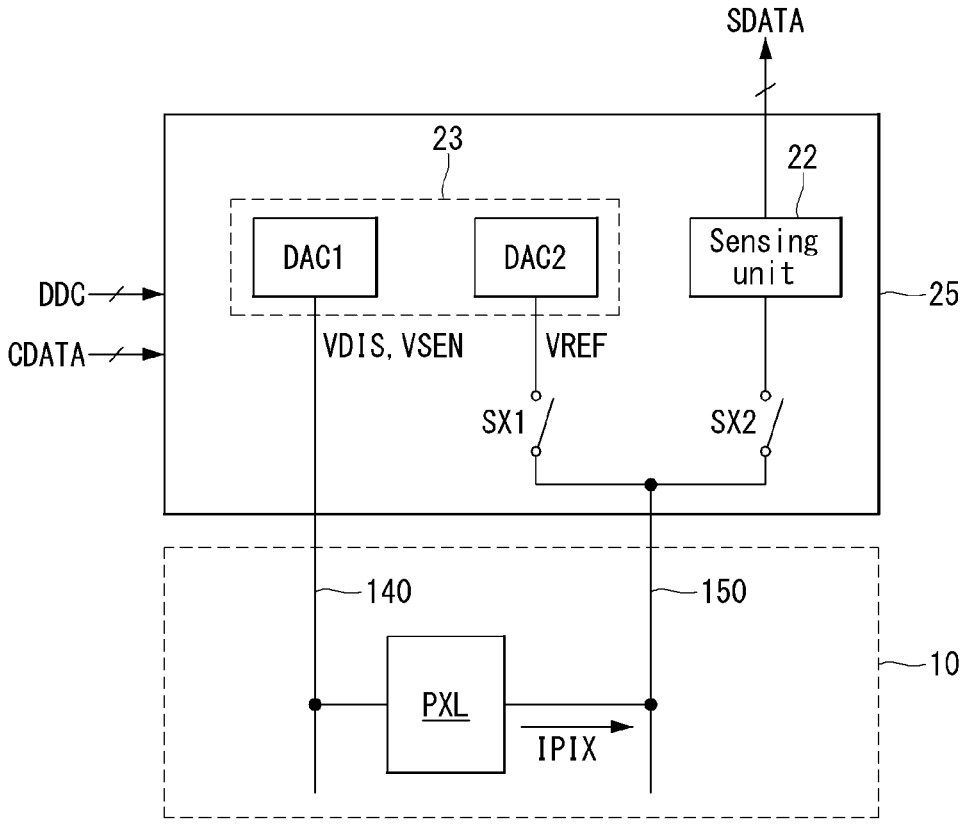
FIG. 3 is a diagram showing one configuration of a data driver connected to the pixel array of FIG. 2.

FIG. 3 is a diagram showing one configuration of the data driver 25 connected to the pixel array of FIG. 2. The data driver 25 of FIG. 3 is for sensing the driving characteristics of pixels PXL through the reference voltage lines 150.

Referring to FIG. 3, the data driver 25 may be connected to the first node of a pixel PXL (connected to the gate electrode of a driving element) through a data line 140, and may be connected to the second node of the pixel PXL (connected to the source electrode of the driving element) through a reference voltage line 150. The reference voltage line 150 connected to the second node through a second switch element may be used as a sensing line because a pixel current IPIX flows into the second node of the pixel PXL.

The reference voltage line 150 is selectively connected to the driving voltage generator 23 and the sensing unit 22 through connection switches SX1 and SX2. The driving voltage generator 23 may include a first driving voltage generator DAC1 for generating the data voltage for sensing VSEN and the data voltage for display VDIS and a second driving voltage generator DAC2 for generating the pixel reference voltage VREF. The first connection switch SX1 is connected between the reference voltage line 150 and the second driving voltage generator DAC2. The second connection switch SX2 is connected between the reference voltage line 150 and the sensing unit 22. The first connection switch SX1 and the second connection switch SX2 are selectively turned on. The first connection switch SX1 only is turned on in synchronization with timing when the pixel reference voltage VREF is written in the pixel PXL. The second connection switch SX2 only is turned on in synchronization with timing when the pixel current IPIX flowing into the pixel PXL is sensed. Accordingly, the reference voltage line 150 is selectively connected to the second driving voltage generator DAC2 and the sensing unit 22 through the first and second connection switches SX1 and SX2.

Figure 4:
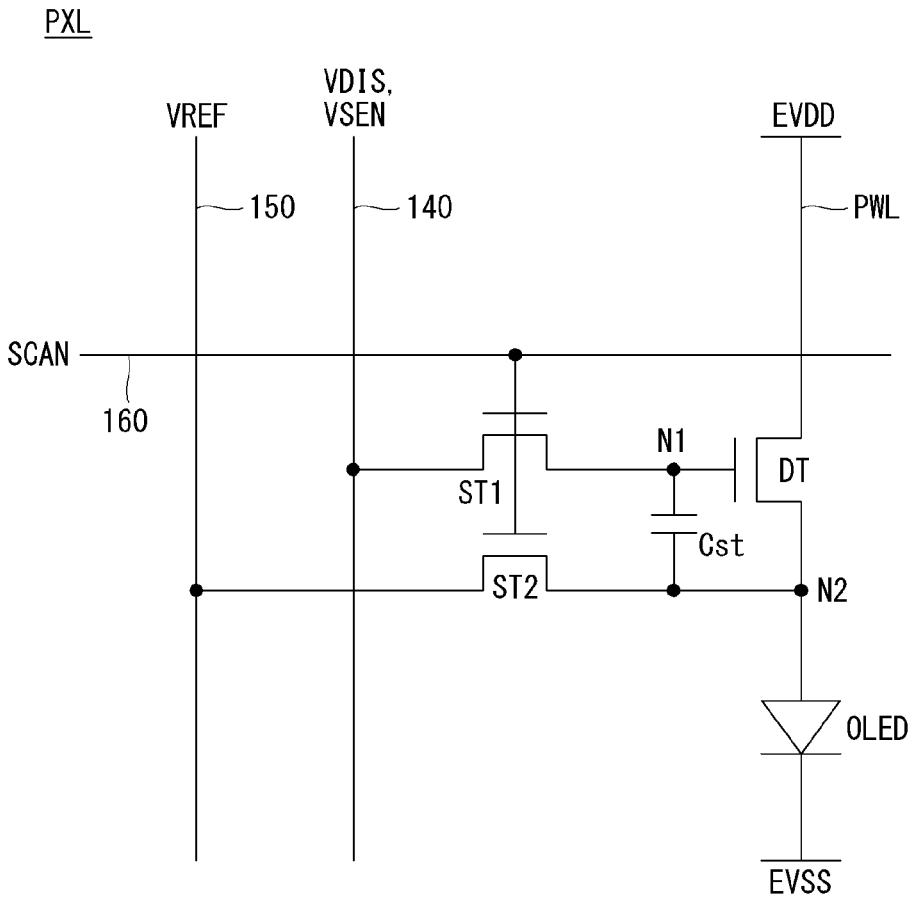
FIG. 4 is an equivalent circuit diagram of a pixel shown in FIG. 3.

FIG. 4 is an equivalent circuit diagram of the pixel shown in FIG. 3.

Referring to FIG. 4, one pixel PXL using the reference voltage line 150 as a sensing line includes an OLED, a driving TFT DT, switches TFTs ST1 and ST2, and a storage capacitor Cst. The driving TFT DT and the switches TFTs ST1 and ST2 may be implemented by NMOSs, but are not limited thereto.

The OLED is a light-emitting device that emits light with intensity corresponding to a pixel current received from the driving TFT DT. The anode electrode of the OLED is connected to a second node N2, and the cathode electrode thereof is connected to the input stage of a low potential pixel voltage EVSS.

The driving TFT DT is a driving element that generates a pixel current in response to a gate-source voltage. The gate electrode of the driving TFT DT is connected to a first node N1. The first electrode of the driving TFT DT is connected to the input stage of a high potential pixel voltage EVDD through a high potential power line PWL. The second electrode of the driving TFT DT is connected to the second node N2. In some embodiments, the first electrode of the driving TFT DT is a drain electrode and the second electrode of the driving TFT DT is a source electrode.

The switches TFTs ST1 and ST2 are switch elements that set a gate-source voltage of the driving TFT DT and that connect the second electrode of the driving TFT DT and the reference voltage line 150.

The first switch TFT ST1 is connected between the data line 140 and the first node N1 and is turned on in response to a gate signal SCAN from the gate line 160. The first switch TFT ST1 is turned on upon programming for display driving or sensing driving. When the first switch TFT ST1 is turned on, the data voltage for sensing VSEN or the data voltage for display VDIS is applied to the first node N1. The gate electrode of the first switch TFT ST1 is connected to the gate line 160. The first electrode of the first switch TFT ST1 is connected to the data line 140. The second electrode of the first switch TFT ST1 is connected to the first node N1.

The second switch TFT ST2 is connected between the reference voltage line 150 and the second node N2 and is turned on in response to the gate signal SCAN from the gate line 160. The second switch TFT ST2 is turned on upon programming for display driving or sensing driving, and applies the pixel reference voltage VREF to the second node N2. Furthermore, the second switch TFT ST2 is turned on even in a sensing period during sensing driving, and applies a pixel current, generated by the driving TFT DT, to the reference voltage line 150. The gate electrode of the second switch TFT ST2 is connected to the gate line 160. The first electrode of the second switch TFT ST2 is connected to the reference voltage line 150. The second electrode of the second switch TFT ST2 is connected to the second node N2.

The storage capacitor Cst is connected between the first node N1 and the second node N2, and maintains the gate-source voltage of the driving TFT DT for a specific period.

Figure 5:
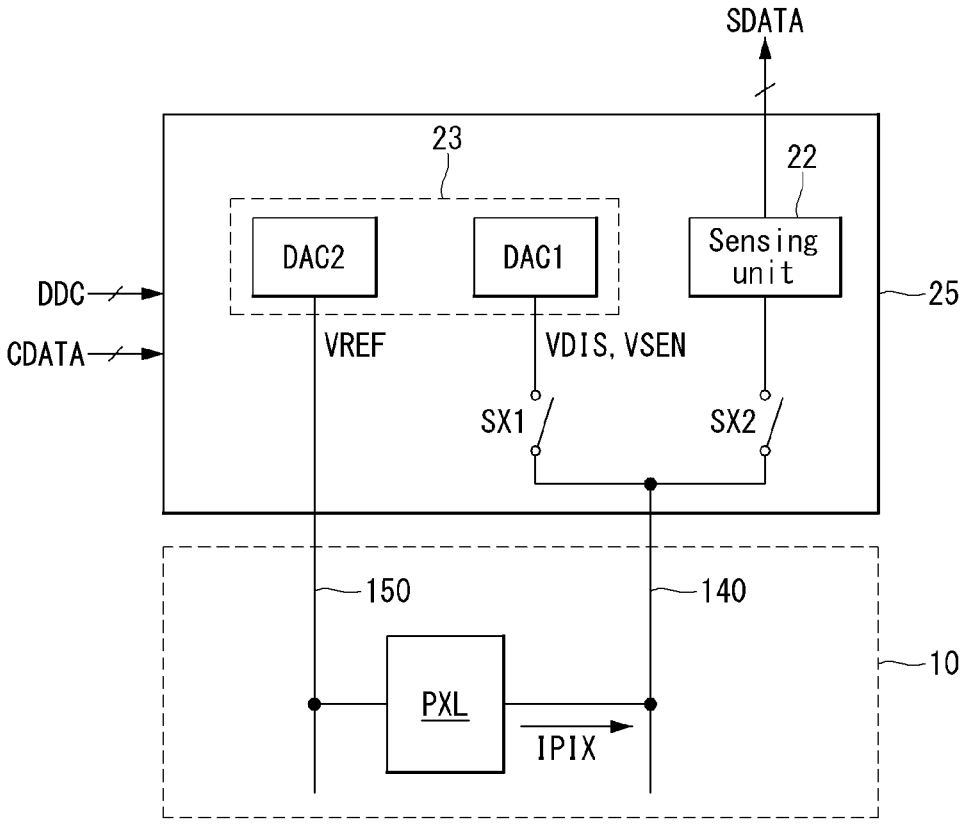
FIG. 5 is a diagram showing another configuration of a data driver connected to the pixel array of FIG. 2.

FIG. 5 is a diagram showing another configuration of the data driver 25 connected to the pixel array of FIG. 2. The data driver 25 of FIG. 5 is for sensing the driving characteristics of pixels PXL through the data line 140.

Referring to FIG. 5, the data driver 25 may be connected to the first node of a pixel PXL (connected to the gate electrode of a driving element) through a reference voltage line 150, and may be connected to the second node of the pixel PXL (connected to the source electrode of the driving element) through a data line 140. The data line 140 connected to the second node through a second switch element may be used as a sensing line because a pixel current IPIX flows into the second node of the pixel PXL.

The data line 140 is selectively connected to the driving voltage generator 23 and the sensing unit 22 through connection switches SX1 and SX2. The driving voltage generator 23 may include a first driving voltage generator DAC1 for generating the data voltage for sensing VSEN and the data voltage for display VDIS and a second driving voltage generator DAC2 for generating the pixel reference voltage VREF. The first connection switch SX1 is connected between the data line 140 and the first driving voltage generator DAC1. The second connection switch SX2 is connected between the data line 140 and the sensing unit 22. The first connection switch SX1 and the second connection switch SX2 are selectively turned on. The first connection switch SX1 only is turned on in synchronization with timing when the data voltage for sensing VSEN and the data voltage for display VDIS are written in the pixel PXL. The second connection switch SX2 only is turned on in synchronization with timing when a pixel current IPIX flowing into the pixel PXL is sensed. Accordingly, the data line 140 is selectively connected to the first driving voltage generator DAC1 and the sensing unit 22 through the first and second connection switches SX1 and SX2.

Figure 6:
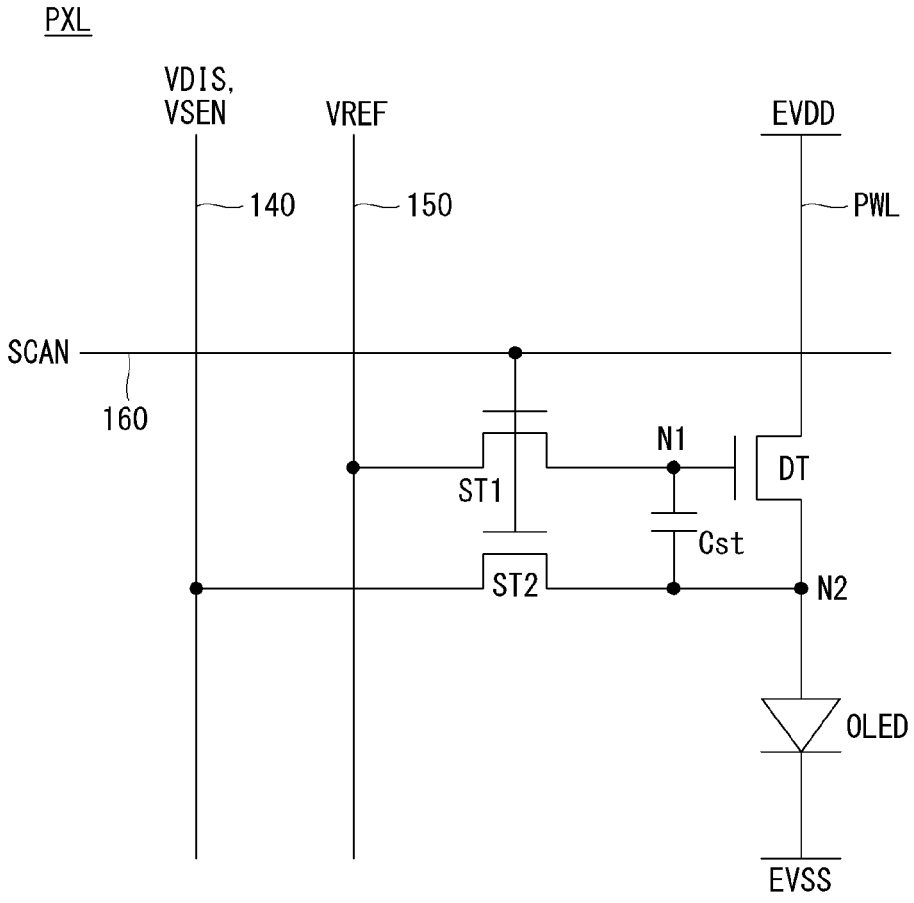
FIG. 6 is an equivalent circuit diagram of a pixel shown in FIG. 5.

FIG. 6 is an equivalent circuit diagram of the pixel shown in FIG. 5.

Referring to FIG. 6, one pixel PXL using a data line 140 as a sensing line includes an OLED, a driving TFT DT, switches TFTs ST1 and ST2, and a storage capacitor Cst. The driving TFT DT, the switches TFTs ST1 and ST2 may be implemented by NMOSs, but are not limited thereto.

The OLED is a light-emitting device that emits light with intensity corresponding to a pixel current received from the driving TFT DT. The anode electrode of the OLED is connected to a second node N2, and the cathode electrode thereof is connected to the input stage of a low potential pixel voltage EVSS.

The driving TFT DT is a driving element that generates a pixel current in response to a gate-source voltage. The gate electrode of the driving TFT DT is connected to a first node N1. The first electrode of the driving TFT DT is connected to the input stage of a high potential pixel voltage EVDD through a high potential power line PWL. The second electrode of the driving TFT DT is connected to the second node N2.

The switches TFTs ST1 and ST2 are switch elements that set a gate-source voltage of the driving TFT DT and that connect the second electrode of the driving TFT DT and the data line 140.

The first switch TFT ST1 is connected between a reference voltage line 150 and the first node N1, and is turned on in response to a gate signal SCAN from a gate line 160. The first switch TFT ST1 is turned on upon programming for display driving or sensing driving. When the first switch TFT ST1 is turned on, a pixel reference voltage VREF is applied to the first node N1. The gate electrode of the first switch TFT ST1 is connected to the gate line 160. The first electrode of the first switch TFT ST1 is connected to the reference voltage line 150. The second electrode of the first switch TFT ST1 is connected to the first node N1.

The second switch TFT ST2 is connected between the data line 140 and the second node N2, and is turned on in response to a gate signal SCAN from the gate line 160. The second switch TFT ST2 is turned on upon programming for display driving or sensing driving, and applies a data voltage for sensing VSEN or a data voltage for display VDIS to the second node N2. Furthermore, the second switch TFT ST2 is turned on even in a sensing period during sensing driving, and applies a pixel current, generated by the driving TFT DT, to the data line 140. The gate electrode of the second switch TFT ST2 is connected to the gate line 160. The first electrode of the second switch TFT ST2 is connected to the data line 140. The second electrode of the second switch TFT ST2 is connected to the second node N2.

The storage capacitor Cst is connected between the first node N1 and the second node N2, and maintains a gate-source voltage of the driving TFT DT for a specific period.

Figure 7:
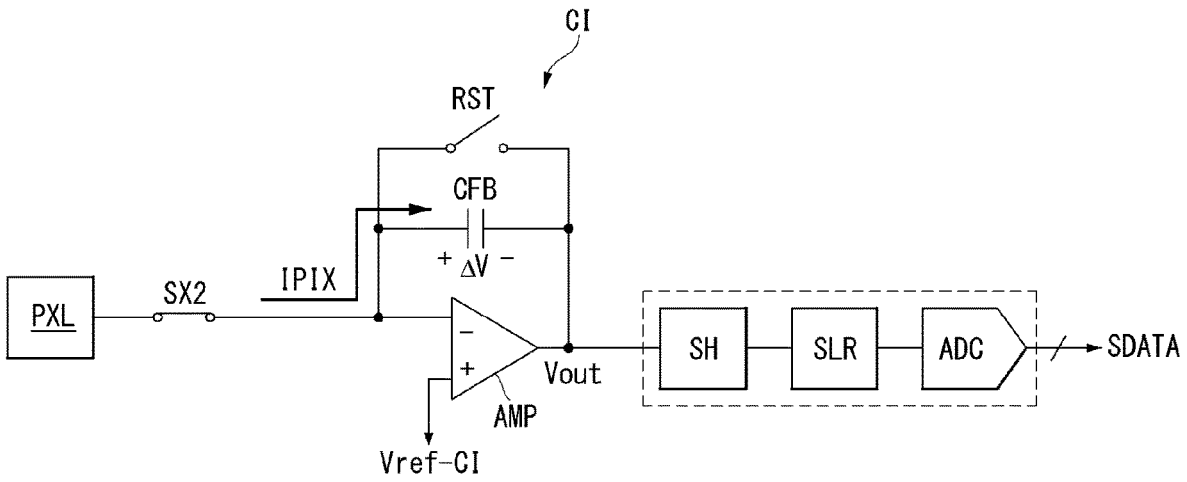
FIGS. 7 and 8 are comparison examples of the present disclosure, and are diagrams showing the existing pixel sensing device and an operation thereof.
Figure 8:
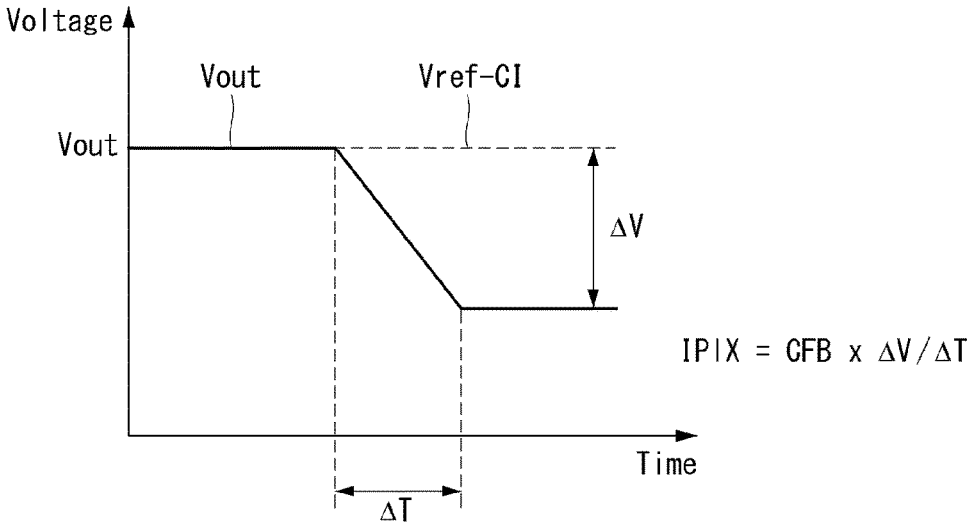

FIGS. 7 and 8 are comparison examples of the present disclosure, and are diagrams showing the existing pixel sensing device and an operation thereof.

Referring to FIG. 7, a pixel sensing device according to a comparison example of the present disclosure may include a current integrator, a sample and hold circuit SH, a scaler circuit SLR, and an ADC.

The current integrator includes an amplifier AMP, an integrated capacitor CFB, and a reset switch RST. The amplifier AMP includes an inverting (−) input terminal receiving a pixel current IPIX from a sensing line, a non-inverting (+) input terminal receiving an integrator reference voltage Vref-CI, and an output terminal from which a sensing output voltage Vout is generated. The integrated capacitor CFB and the reset switch RST are connected in parallel between the inverting (−) input terminal and output terminal of the amplifier AMP.

The sample and hold circuit SH includes a sampling switch for sampling the sensing output voltage Vout, a holding capacitor for storing the sampled voltage, and a holding switch for outputting the sampling voltage stored in the holding capacitor. The scaler circuit SLR is a circuit that changes a voltage level, sampled by the sample and hold circuit SH, based on the input range of the ADC.

The ADC converts the sensing output voltage Vout through the scaler circuit SLR into a digital signal. A sensible input voltage range, that is, a sensing range, has been previously determined in the ADC. However, an actually sensible section in the ADC is narrower than a sensing range specified in the ADC because reliability is low at the start part and end part of the sensing range.

As shown in FIG. 8, in the pixel sensing device of FIG. 7, as the pixel current IPIX is accumulated in the integrated capacitor CFB during a specific time ΔT, the sensing output voltage Vout loaded on the output terminal of the amplifier AMP linearly decreases by ΔV from the integrator reference voltage Vref-CI, and the reduced voltage Vout is measured by the ADC. In the existing sensing method, ΔV and a change in the pixel current IPIX are found based on the output of the ADC (IPIX=CFB*ΔV/ΔT).

The pixel sensing device of FIG. 7 has a large circuit size due to the sample and hold circuit SH and the scaler circuit SLR and has low accuracy of sensing because the sensible range of the ADC is narrow.

Figure 9:
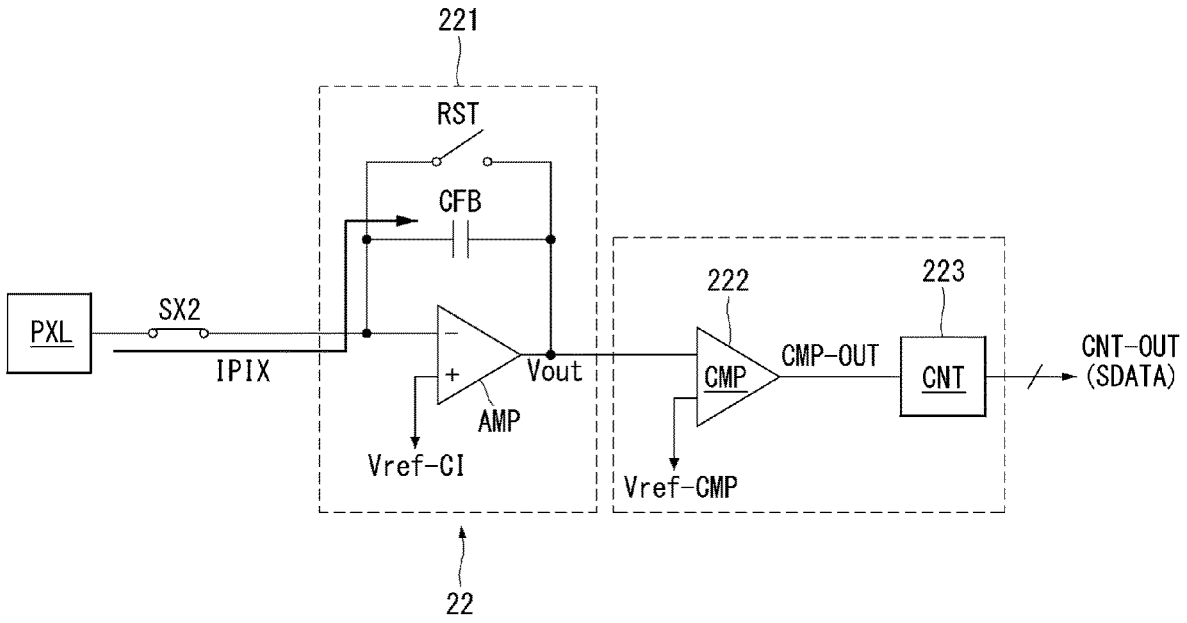
FIG. 9 is a diagram showing a pixel sensing device according to an embodiment of the present disclosure.
Figure 10:
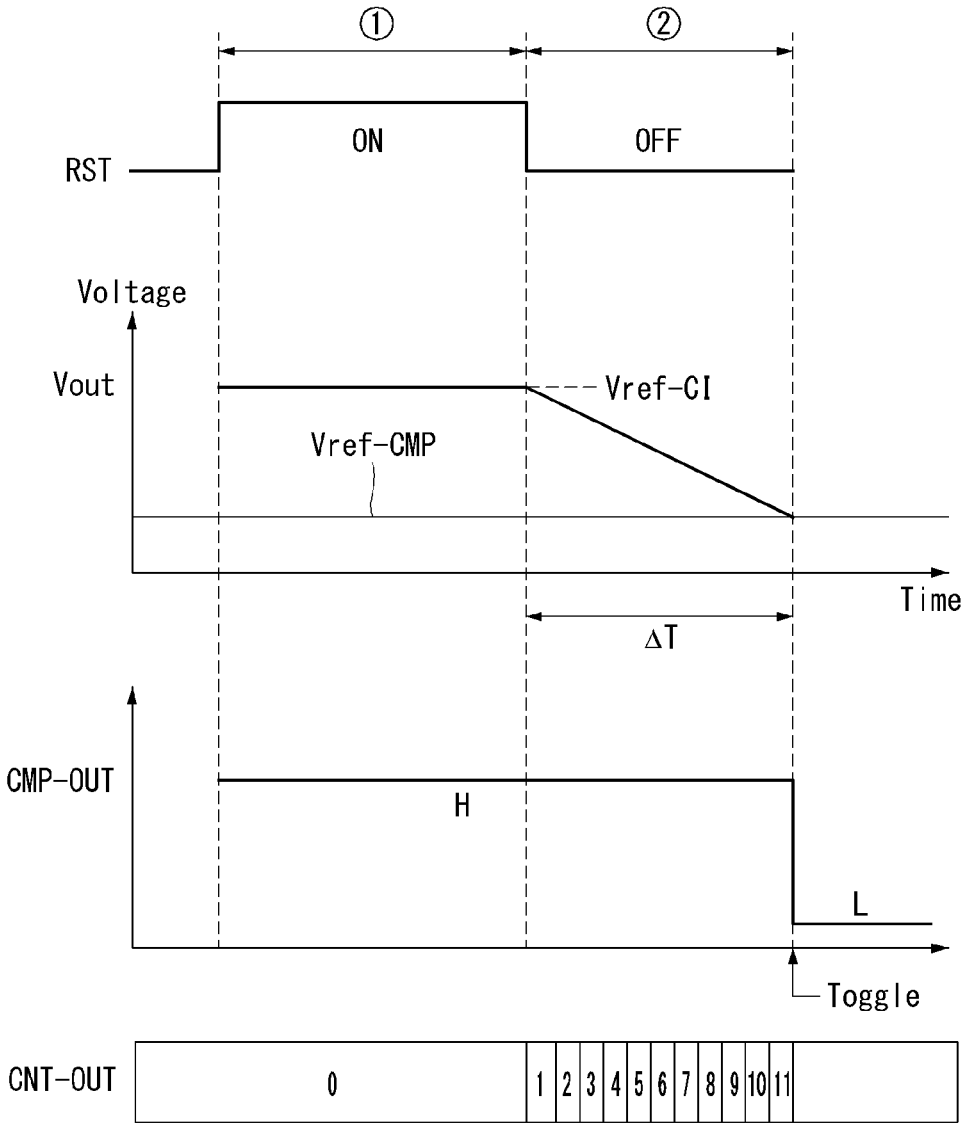
FIG. 10 shows a driving waveform for illustrating an operation of the pixel sensing device according to an embodiment of the present disclosure.

FIG. 9 is a diagram showing a pixel sensing device according to an embodiment of the present disclosure. Furthermore, FIG. 10 shows a driving waveform for illustrating an operation of the pixel sensing device according to an embodiment of the present disclosure.

The pixel sensing device according to an embodiment of the present disclosure corresponds to the sensing unit 22 of FIG. 1, 3 or 5. The sensing unit 22 to be described later according to an embodiment of the present disclosure does not find out a change in the pixel current IPIX based on the voltage change ΔV of the sensing output voltage Vout, but senses the time taken for the sensing output voltage to reach a specific voltage. In an embodiment of the present disclosure, a change in the pixel current IPIX is determined based on the time taken for a sensing output voltage to reach a specific voltage.

The sensing unit 22 according to an embodiment of the present disclosure may include a current integrator 221, a comparator COMP 222, a counter CNT 223 as shown in FIG. 9.

The current integrator 221 is connected to one pixel PXL through a sensing line of the display panel 10. The current integrator 221 generates a sensing output voltage Vout, varying from an integrator reference voltage Vref-CI, by integrating a pixel current IPIX flowing into the pixel PXL.

The current integrator 221 includes an amplifier AMP, an integrated capacitor CFB, and a reset switch RST. The amplifier AMP includes an inverting (−) input terminal receiving the pixel current IPIX from the sensing line, a non-inverting (+) input terminal receiving the integrator reference voltage Vref-CI, and an output terminal from which the sensing output voltage Vout is generated. The integrated capacitor CFB is connected between the inverting (−) input terminal and output terminal of the amplifier AMP. The reset switch RST is connected between the inverting (−) input terminal and output terminal of the amplifier AMP in parallel to the integrated capacitor CFB.

In an initialization period ① of FIG. 10, when the reset switch RST is turned on, the inverting (−) input terminal, non-inverting (+) input terminal and output terminal of the amplifier AMP are reset as the integrator reference voltage Vref-CI. At this time, the integrator reference voltage Vref-CI is output as the sensing output voltage Vout.

In a sensing period ② of FIG. 10, when the reset switch RST is turned off and the pixel current IPIX is applied to the integrated capacitor CFB, the sensing output voltage Vout generated from the output terminal of the amplifier AMP gradually decreases from the integrator reference voltage Vref-CI. At this time, the decrement slope of the sensing output voltage Vout is proportional to the size of the pixel current IPIX.

The structure of the current integrator 221 may be changed so that the integrator reference voltage Vref-CI is input to the inverting (−) input terminal of the amplifier AMP and the integrated capacitor CFB and the reset switch RST are connected to the non-inverting (+) input terminal of the amplifier AMP. In this case, the sensing output voltage Vout generated from the output terminal of the amplifier AMP may gradually rise from the integrator reference voltage Vref-CI because the pixel current IPIX received from the sensing line is applied to the integrated capacitor CFB via the non-inverting (+) input terminal of the amplifier AMP. At this time, the rise slope of the sensing output voltage Vout is proportional to the size of the pixel current IPIX.

The technical spirit of the present disclosure is not limited to the structure of the current integrator 221. Accordingly, the sensing output voltage Vout may gradually decrease or increase from the integrator reference voltage Vref-CI. That is, the sensing output voltage Vout may be changed from the integrator reference voltage Vref-CI in accordance with the pixel current IPIX accumulated in the integrated capacitor CFB.

The comparator COMP 222 compares the sensing output voltage Vout, varying from the integrator reference voltage Vref-CI, with a preset comparator reference voltage Vref-CMP. The comparator COMP 222 toggles a comparator output signal CMP-OUT when the sensing output voltage Vout becomes equal to the comparator reference voltage Vref-CMP. In this case, the comparator reference voltage Vref-CMP is set to be fixed to a specific level. The comparator reference voltage Vref-CMP may be implemented as a ramp signal. In this case, in terms of noise, stability may be degraded and a deviation between ICs may occur. In an embodiment of the present disclosure, the comparator circuit can be simplified by setting the comparator reference voltage Vref-CMP as a specific level, and the accuracy of sensing can be improved by reducing an external noise influence.

The comparator COMP 222 maintains the comparator output signal CMP-OUT to a first logic value H right before a second point of time (end timing of the sensing period ②) at which the sensing output voltage Vout becomes equal to the comparator reference voltage Vref-CMP from a first point of time (start timing of the sensing period ②) at which the sensing output voltage Vout starts to change from the integrator reference voltage Vref-CI, and toggles the comparator output signal CMP-OUT from the first logic value H to a second logic value L at the second point of time.

The counter CNT 223 starts a count operation at the first point of time based on an input count clock, and terminates (or stops) the count operation at the second point of time. That is, the counter CNT 223 counts a time ΔT during which the comparator output signal CMP-OUT is maintained to the first logic value H, and outputs a corresponding count value CNT-OUT as sensing result data SDATA.

When the driving characteristics of the pixel PXL are changed, the pixel current IPIX flowing into the pixel PXL is changed in response to the same data voltage for sensing VSEN. When the pixel current IPIX is changed, a change slope of the sensing output voltage Vout varying from the integrator reference voltage Vref-CI is changed. As a result, the time ΔT taken for the sensing output voltage Vout and the comparator reference voltage Vref-CMP to become equal is changed. In an embodiment of the present disclosure, a change in the pixel current IPIX is found out based on the time ΔT taken for the sensing output voltage Vout to reach the reference voltage Vref-CMP (IPIX=CFB*{Vref-CI−Vref-CMP}/ΔT).

As described above, the sensing unit 22 according to an embodiment of the present disclosure does not require the existing sample and hold circuit, scaler circuit and ADC. The sensing unit 22 according to an embodiment of the present disclosure can easily reduce the chip size and fabrication cost of the driver IC D-IC 20 because it can be implemented without the sample and hold circuit and the scaler circuit.

Furthermore, the counter CNT 223 according to an embodiment of the present disclosure has a wider available sensing range than the existing ADC for voltage measurement. That is, if the counter CNT 223 is a 10-bit counter, it has a wider sensing range than the existing ADC because all 10 bits are used. Accordingly, the sensing unit 22 according to an embodiment of the present disclosure can solve a sensing reliability degradation problem attributable to the ADC sensing range restriction because it can be implemented without the ADC.

Figure 11:
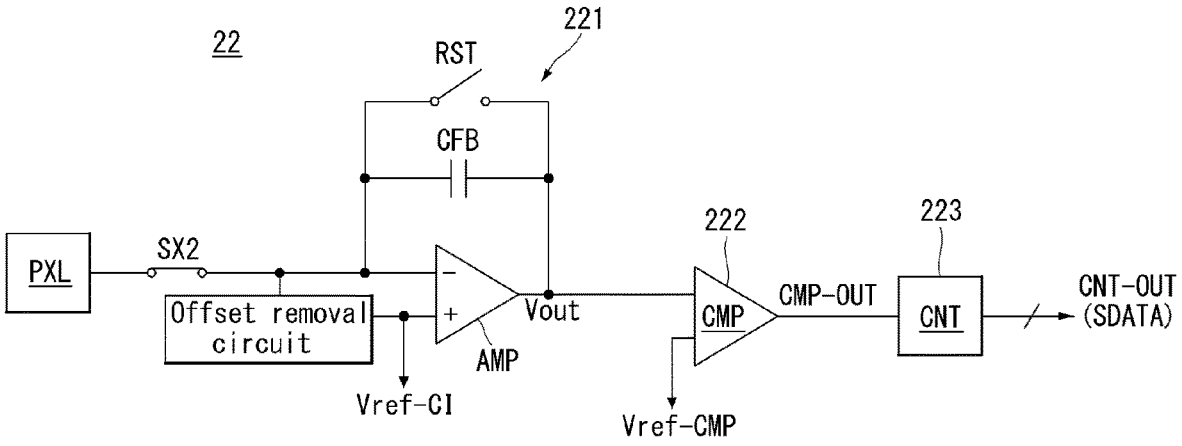
FIGS. 11 and 12 are diagrams showing modified examples of a pixel sensing device according to an embodiment of the present disclosure.
Figure 12:
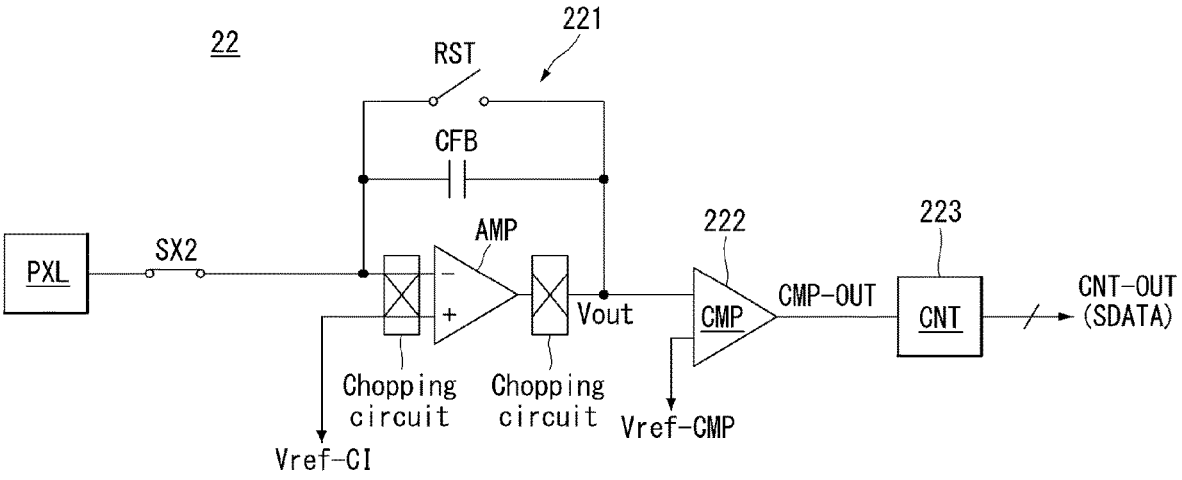

FIGS. 11 and 12 are diagrams showing modified examples of a pixel sensing device according to an embodiment of the present disclosure.

Referring to FIG. 11, the sensing unit 22 according to an embodiment of the present disclosure may further include an offset removal circuit connected between the inverting (−) input terminal and non-inverting (+) input terminal of the amplifier AMP.

The offset removal circuit corrects the integrator reference voltage Vref-CI, input to the non-inverting (+) input terminal of the amplifier, by offsetting an offset deviation which may occur between the inverting (−) input terminal and non-inverting (+) input terminal of the amplifier AMP so that the integrator reference voltage Vref-CI is identically applied to the inverting (−) input terminal of the amplifier.

Referring to FIG. 12, the sensing unit 22 according to an embodiment of the present disclosure may further include chopping circuits connected to the inverting (−) input terminal, non-inverting (+) input terminal and output terminal of the amplifier AMP.

The chopping circuit is for correcting an error which may occur in the sensing output voltage Vout by the offset of the amplifier AMP, and corrects an error so that an offset influence is offset through an average of the output of a normal circuit and the output of an inverting circuit.

Figure 13:
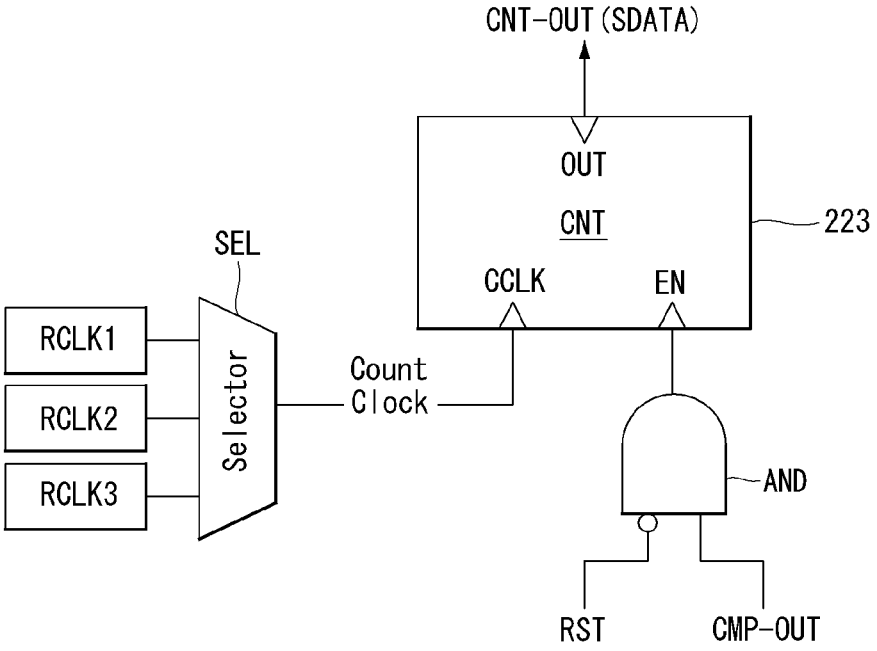
FIG. 13 is a diagram showing a configuration for varying sensing resolution by changing a count clock in a pixel sensing device according to an embodiment of the present disclosure.
Figure 14:
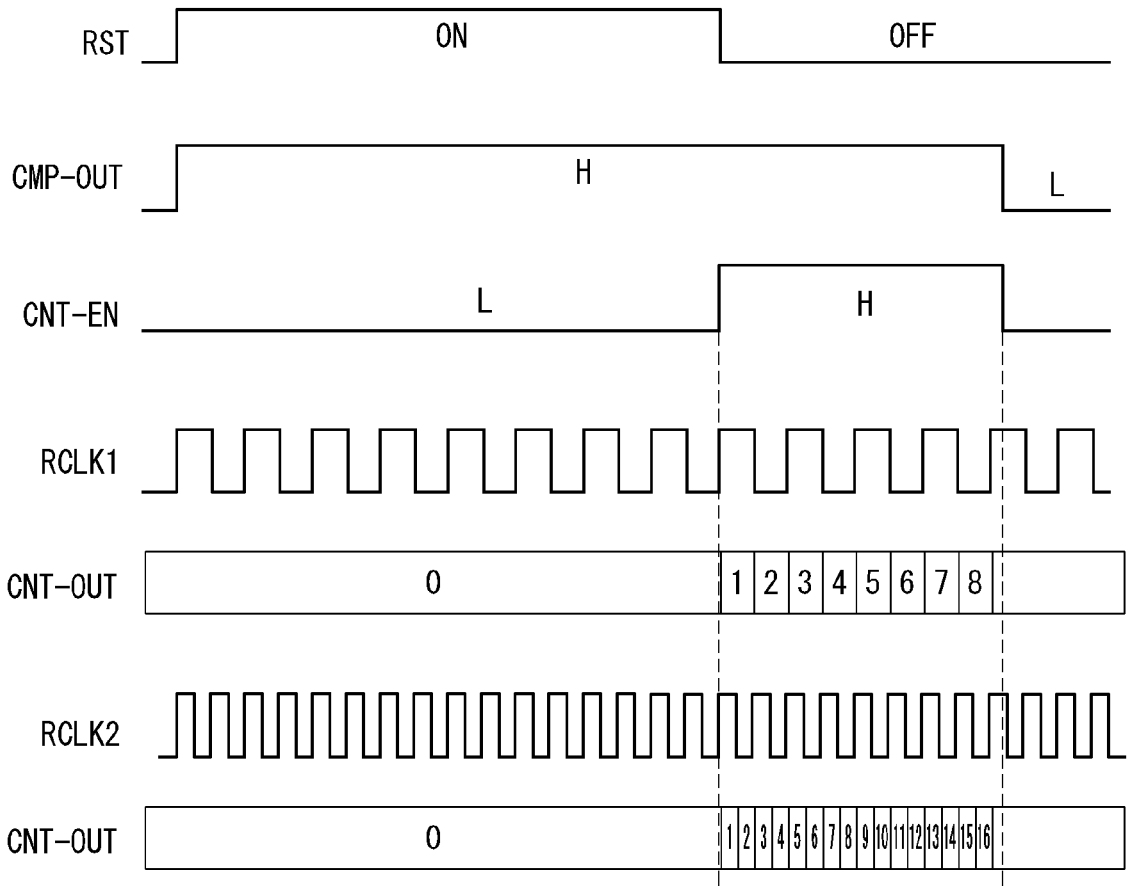
FIG. 14 shows driving waveforms for illustrating an operation of the configuration for varying sensing resolution by changing the count clock of FIG. 13.

FIGS. 13 and 14 are diagrams showing a configuration and operation for varying sensing resolution by changing a count clock in the pixel sensing device according to an embodiment of the present disclosure.

Referring to FIGS. 13 and 14, the sensing unit 22 according to an embodiment of the present disclosure may further include a selector SEL and an AND element AND.

The selector SEL selects any one of a plurality of reference clocks RCLK1~RCLK3, having different clock speeds, as a count clock CCLK, and inputs the count clock to the counter CNT 223.

The selector SEL increases the clock speed of a reference clock, selected as the count clock CCLK, as the time during which the comparator output signal CMP-OUT is maintained to the first logic value H is reduced. Accordingly, the accuracy and reliability of sensing can be improved by implementing more precise sensing.

The selector SEL decreases the clock speed of a reference clock, selected as the count clock CCLK, as the time during which the comparator output signal CMP-OUT is maintained to the first logic value H is increased. Accordingly, the accuracy and reliability of sensing can be improved by preventing the saturation phenomenon of a sensing value.

The AND element AND activates (EN,H) an operation of the counter CNT 223 only when the reset switch RST of the current integrator 221 is turned off and the comparator output signal CMP-OUT has the first logic value H. When the comparator output signal CMP-OUT toggles to the second logic value L, the AND element AND stops (EN,L) an operation of the counter CNT 223.

As described above, the sensing unit according to an embodiment of the present disclosure includes the comparator and the counter in order to sense the time taken for a sensing output voltage of the current integrator to reach a specific voltage.

According to an embodiment of the present disclosure, the existing sample and hold circuit, scaler circuit and ADC are not necessary. The sensing unit according to an embodiment of the present disclosure can easily reduce the chip size and fabrication cost of a driver IC because it can be implemented without a sample and hold circuit and a scaler circuit.

Furthermore, the counter included in the sensing unit according to an embodiment of the present disclosure is advantageous to improve the accuracy and reliability of sensing because it has a wider available sensing range than the existing ADC for voltage measurement.

Those skilled in the art will understand that the present disclosure may be changed and modified in various ways without departing from the technical spirit of the present disclosure through the above-described contents. Accordingly, the technological scope of the present disclosure is not limited to the contents described in the detailed description of the specification, but should be determined by the claims.

What is claimed is:

1. A display device comprising:

a display panel;

a sensing circuit coupled to the display panel, the sensing circuit for sensing a current generated by a pixel of the display panel, the sensing circuit comprising:

an integrator circuit, the integrator circuit initialized to have a first reference voltage level as an output, wherein the output of the integrator circuit changes with a rate according to the sensed current, a comparator coupled to the output of the integrator circuit and comparing the output of the integrator circuit to a second reference voltage level, and a counter coupled to an output of the comparator, the counter for determining a time for the output of the integrator circuit to reach the second reference voltage level from the first reference voltage level;

a selector receiving as inputs a plurality of clock signals each having a different frequency, the selector selecting one of the plurality of clock signals as a count clock signal and supplying the count clock signal to the counter, the count clock signal having a first frequency responsive to a first predicted time for the output of the integrator circuit to change from the first reference voltage level to the second reference voltage level or having a second frequency responsive to a second predicted time for the output of the integrator circuit to change from the first reference voltage level to the second reference voltage level, wherein the first frequency is faster than the second frequency when the first predicted time is shorter than the second predicted time; and a compensation circuit coupled to the sensing circuit, the compensation circuit receiving the determined time, determining a compensation amount from the received time, and compensating a display voltage for the pixel by the determined compensation amount in a subsequent display frame of the display device.

2. The display device of claim 1, wherein the integrator circuit comprises:

an amplifier having a first input receiving a first reference voltage having the first reference voltage level and a second input coupled to an output of the pixel;

a feedback capacitor coupled between the second input of the amplifier and an output of the amplifier; and a reset switch coupled between the second input of the amplifier and the output of the amplifier and in parallel with the feedback capacitor.

3. The display device of claim 2, wherein the reset switch is closed to initialize the output of the integrator circuit to be the first reference voltage.

4. The display device of claim 3, wherein the reset switch is opened after the output of the integrator circuit has been initialized to allow the output of the integrator circuit to change.

5. The display device of claim 1, wherein the comparator has a first input receiving the output of the integrator circuit and a second input for receiving a second reference voltage having the second reference voltage level.

6. The display device of claim 5, further comprising an offset removal circuit coupled to the first input and the second input of the integrator circuit, the offset removal circuit for correcting an offset between the first input of the integrator circuit and the second input of the integrator circuit.

7. The display device of claim 5, wherein an output of the comparator has a first value for enabling the counter when the output of the integrator circuit is greater than the second reference voltage level, and a second value for disabling the counter when the output of the integrator circuit is lower than the second reference voltage level.

8. The display device of claim 7, wherein the counter receives the counter clock signal, the counter configured to count clock pulses of the clock signal when the output of the comparator has the first value.

9. The display device of claim 1, wherein the sensed current is generated by a driving transistor of the pixel in response to a preset data voltage.

10. A pixel sensing circuit for a display device, comprising:

a sensing circuit coupled to a display panel, the sensing circuit for sensing a current generated by a pixel of the display panel, the sensing circuit comprising:

an integrator circuit, the integrator circuit initialized to have a first reference voltage level as an output, wherein the output of the integrator circuit changes with a rate according to the sensed current, a comparator coupled to the output of the integrator circuit, the comparator for comparing the output of the integrator circuit to a second reference voltage level, a counter coupled to an output of the comparator, the counter for determining a time for the output of the integrator circuit to reach the second reference voltage level from the first reference voltage level, and a selector receiving as inputs a plurality of clock signals each having a different frequency, the selector selecting one of the plurality of clock signals as a count clock signal and supplying the count clock signal to the counter, the count clock signal having a first frequency responsive to a first predicted time for the output of the integrator circuit to change from the first reference voltage level to the second reference voltage level or having a second frequency responsive to a second predicted time for the output of the integrator circuit to change from the first reference voltage level to the second reference voltage level, wherein the first frequency is faster than the second frequency when the first predicted time is shorter than the second predicted time.

11. The pixel sensing circuit of claim 10, wherein the comparator has a first input receiving the output of the integrator circuit and a second input for receiving a second reference voltage having the second reference voltage level, and wherein an output of the comparator has a first value for enabling the counter when the output of the integrator circuit is greater than the second reference voltage level, and a second value for disabling the counter when the output of the integrator circuit is lower than the second reference voltage level.

12. A method for sensing a pixel of a display device, the method comprising:

generating an output voltage of a sensing circuit based on pixel current from the pixel of the display device;

counting a number of clock pulses of a count clock signal to determine a time for the output voltage of the sensing circuit to change from a first reference voltage level to a second reference voltage level;

determining a compensation amount from the determined time; and compensating a display voltage for the pixel by the determined compensation amount in a subsequent display frame of the display device, wherein counting the number of clock pulses of the count clock signal comprises:

selecting the count clock signal from a plurality of clock signals each of which has a different frequency, the selected clock signal having a first frequency responsive to a first predicted time for the output of the sensing circuit to change from the first reference voltage level to the second reference voltage level or having a second frequency responsive to a second predicted time for the output of the sensing circuit to change from the first reference voltage level to the second reference voltage level, wherein the first frequency is faster than the second frequency when the first predicted time is shorter than the second predicted time.

13. The method of claim 12, wherein the sensing circuit includes an integrator circuit, and:

wherein generating the output voltage of the sensing circuit based on the pixel current comprises:

initializing an output of the integrator circuit to have the first reference voltage level, and integrating the pixel current to generate the output of the integrator circuit with a rate according to a magnitude of the pixel current; and wherein determining the time for the output voltage of the sensing circuit to change from the first reference voltage level to the second reference voltage level comprises:

determining a time for the output of the integrator circuit to change from the first reference voltage level to the second reference voltage level.

14. The method of claim 13, further comprising:

correcting an offset between a first input and a second input of the integrator circuit during initialization of the output of the integrator circuit.

15. The method of claim 12, wherein determining the time for the output voltage of the sensing circuit to change from the first reference voltage level to the second reference voltage level comprises:

enabling the counter to start counting the number of clock pulses of the clock signal; and disabling the counter to stop counting the number of clock pulses of the clock signal when the output of the sensing circuit reaches the second reference voltage level or less.

16. The method of claim 12, wherein counting the number of clock pulses of the count clock signal further comprises:

comparing the output of the sensing circuit to the second reference voltage level;

generating a counter enable signal to have a first value when the output of the sensing circuit is larger than the second reference voltage level; and generating the counter enable signal to have a second value when the output of the sensing circuit is lower than the second reference voltage level.

17. The method of claim 16, wherein counting the number of clock pulses of the count clock signal further comprises:

enabling the counter when the counter enable signal has the first value.

* * * * *